US010183407B2

(12) United States Patent
Griffin et al.

(10) Patent No.: US 10,183,407 B2
(45) **Date of Patent: *Jan. 22, 2019**

(54) SHAVING SYSTEMS

(71) Applicant: SHAVELOGIC, INC., Plano, TX (US)

(72) Inventors: John W. Griffin, Moultonborough, NH (US); Craig A. Provost, Boston, MA (US); William E. Tucker, Attleboro, MA (US)

(73) Assignee: SHAVELOGIC, INC., Dallas, TX (US)

( * ) Notice: Subject to any disclaimer, the term of this patent is extended or adjusted under 35 U.S.C. 154(b) by 36 days.

This patent is subject to a terminal disclaimer.

(21) Appl. No.: 15/298,851

(22) Filed: Oct. 20, 2016

(65) Prior Publication Data

US 2017/0036360 A1 Feb. 9, 2017

Related U.S. Application Data

(63) Continuation of application No. 14/661,032, filed on Mar. 18, 2015, now Pat. No. 9,475,202, which is a continuation of application No. PCT/US2013/052099, filed on Jul. 25, 2013.

(60) Provisional application No. 61/706,533, filed on Sep. 27, 2012, provisional application No. 61/706,537, filed on Sep. 27, 2012.

(51) Int. Cl.

| | |
|---|---|
| ***B26B 21/22*** | (2006.01) |
| ***B26B 21/52*** | (2006.01) |
| ***B26B 21/40*** | (2006.01) |

(52) U.S. Cl.

CPC ..... *B26B 21/225* (2013.01); *B26B 21/4081* (2013.01); *B26B 21/521* (2013.01)

(58) Field of Classification Search

CPC .. B26B 21/225; B26B 21/4081; B26B 21/521

See application file for complete search history.

(56) References Cited

U.S. PATENT DOCUMENTS

| | | | |
|---|---|---|---|
| 996,879 | A | 7/1911 | Odell |
| 1,015,575 | A | 1/1912 | Meyer |

(Continued)

FOREIGN PATENT DOCUMENTS

| | | |
|---|---|---|
| EP | 1245351 | 10/2002 |
| EP | 1488894 | 12/2004 |

(Continued)

OTHER PUBLICATIONS

Search Report—Corresponding European Patent Application No. 13840539, dated Apr. 25, 2016, 7 pages.

(Continued)

*Primary Examiner* — Hwei C Payer

(74) *Attorney, Agent, or Firm* — Leber IP Law; Celia H. Leber

(57) ABSTRACT

Replaceable shaving assemblies are disclosed that include a blade unit, a shell bearing element, and an interface element. The interface element is configured to removeably connect the shaving assembly to a handle, on which the blade unit is pivotably mounted. In some cases, a return element is integrally formed on the shell bearing unit between the blade unit and interface element. Shaving systems including such shaving assemblies are also disclosed, as are methods of using such shaving systems.

12 Claims, 10 Drawing Sheets

(56) References Cited

U.S. PATENT DOCUMENTS 1,074,615 A 10/1913 Folmer
3,311,975 A * 4/1967 De Longuyon ..... B26B 21/165 30/526
3,593,416 A 7/1971 Edson
3,709,517 A 1/1973 Wossner
3,768,348 A 10/1973 Braun et al.
4,094,063 A 6/1978 Trotta
4,347,663 A * 9/1982 Ullmo ..... B26B 21/225 30/47
4,403,414 A 9/1983 Kiraly
4,475,286 A 10/1984 Saito
4,785,534 A 11/1988 Lazarchik
4,834,760 A 5/1989 Richter, Jr.
4,838,564 A 6/1989 Jarvis
4,850,518 A 7/1989 Salmon et al.
4,970,784 A 11/1990 Althaus et al.
5,029,391 A 7/1991 Althaus
3,938,247 A 9/1991 Carbonell et al.
5,074,042 A 12/1991 Althaus et al.
5,168,628 A 12/1992 Mock et al.
5,219,468 A 6/1993 Olson
5,369,885 A 12/1994 Ferraro
5,402,574 A 4/1995 Milner
5,466,901 A 11/1995 Mochizuki
5,533,263 A 7/1996 Gilder
5,551,153 A 9/1996 Simms
5,551,717 A 9/1996 De Courcey Milne
5,560,106 A 10/1996 Armbruster
5,645,603 A 7/1997 Peters
5,661,907 A 9/1997 Apprille, Jr.
5,669,139 A 9/1997 Oldroyd et al.
5,678,316 A 10/1997 Althaus et al.
5,771,591 A 6/1998 Armbruster
5,794,342 A 8/1998 Davey
5,813,293 A 9/1998 Apprille, Jr.
5,855,071 A 1/1999 Apprille et al.
5,890,296 A 4/1999 Metcalf et al.
6,014,918 A 1/2000 Orloff
6,112,412 A 9/2000 Richard
6,122,826 A 9/2000 Coffin et al.
6,138,361 A 10/2000 Follo
6,145,201 A 11/2000 Andrews
6,161,287 A 12/2000 Swanson et al.
4,774,765 A 1/2001 Ferraro
6,182,366 B1 2/2001 Richard
6,216,345 B1 4/2001 Andrews
6,223,442 B1 5/2001 Pina
6,311,400 B1 * 11/2001 Hawes ..... B26B 21/225 30/50
6,357,118 B1 3/2002 Eichhorn et al.
6,502,318 B1 1/2003 Gilder
6,557,265 B2 5/2003 Coffin
6,560,881 B2 5/2003 Coffin
6,612,040 B2 9/2003 Gilder
6,615,498 B1 9/2003 King
6,772,523 B1 8/2004 Richard
6,807,739 B2 10/2004 Folio
6,854,188 B1 2/2005 Wonderley
6,880,253 B1 4/2005 Gyllerstrom
6,973,730 B2 12/2005 Tomassetti
6,990,740 B2 1/2006 Follo
7,028,405 B2 4/2006 Paas et al.
7,086,160 B2 8/2006 Coffin
7,100,284 B2 9/2006 King
7,103,976 B2 9/2006 Pennella
7,152,512 B1 12/2006 Prochaska
7,200,942 B2 4/2007 Richard
7,441,336 B2 10/2008 Hawes et al.
7,461,458 B2 12/2008 Peyser
7,526,869 B2 5/2009 Blatter et al.
7,574,809 B2 8/2009 Follo
7,669,511 B2 3/2010 King
7,797,834 B2 9/2010 Steunenberg
7,802,368 B2 9/2010 Coffin et al.
7,877,879 B2 2/2011 Nakasuka
7,971,363 B2 7/2011 Nakasuka
8,033,023 B2 10/2011 Johnson
8,096,054 B2 1/2012 Denkert
8,166,661 B2 5/2012 King
8,205,343 B2 6/2012 Winter et al.
8,205,344 B2 6/2012 Stevens
8,273,205 B2 9/2012 Murgida
8,307,552 B1 11/2012 Drouillard
8,484,852 B2 7/2013 King
8,499,459 B2 8/2013 Efthimiadis et al.
8,590,162 B2 11/2013 Park et al.
8,640,342 B2 2/2014 Murgida
8,671,577 B2 3/2014 Brown
8,732,955 B2 5/2014 Howell et al.
8,769,825 B2 7/2014 Howell et al.
8,789,282 B2 7/2014 Wilson et al.
8,793,880 B2 8/2014 Taub et al.
8,844,145 B2 9/2014 Psimadas et al.
9,283,685 B2 3/2016 Griffin
9,475,202 B2 * 10/2016 Griffin ..... B26B 21/225
9,486,930 B2 11/2016 Provost et al.
9,902,077 B2 2/2018 Park et al.
2002/0059729 A1 5/2002 Ikuta et al.
2002/0157255 A1 10/2002 Coffin
2003/0046819 A1 3/2003 Ferraro
2003/0154603 A1 8/2003 Guimont et al.
2003/0200659 A1 10/2003 Coffin et al.
2003/0200660 A1 10/2003 Pennella et al.
2003/0205858 A1 11/2003 Hall
2004/0010918 A1 1/2004 Orloff et al.
2004/0177519 A1 9/2004 Tomassetti et al.
2005/0039338 A1 2/2005 King
2005/0207837 A1 9/2005 Kosh et al.
2005/0278954 A1 12/2005 Orloff et al.
2006/0080837 A1 4/2006 Johnson et al.
2006/0080838 A1 4/2006 Johnson
2006/0283025 A1 12/2006 Follo et al.
2007/0151106 A1 7/2007 Steunenberg et al.
2007/0204932 A1 9/2007 Freed
2007/0289139 A1 12/2007 Peyser et al.
2008/0155831 A1 7/2008 Royle
2008/0189964 A1 8/2008 Bozikis
2008/0196251 A1 8/2008 Royle
2009/0000126 A1 1/2009 Kraus
2009/0038167 A1 2/2009 Peyser
2009/0235539 A1 9/2009 Wonderley
2010/0011583 A1 1/2010 Efthimiadis et al.
2010/0043242 A1 2/2010 Stevens
2010/0083505 A1 4/2010 Royle et al.
2011/0017387 A1 * 1/2011 Murgida ..... B26B 21/22 156/242
2011/0088269 A1 4/2011 Walker, Jr. et al.
2011/0138586 A1 6/2011 Gompert et al.
2011/0192031 A1 8/2011 Coresh
2011/0247217 A1 10/2011 Johnson et al.
2012/0060382 A1 3/2012 Beugels et al.
2012/0073554 A1 3/2012 Victor et al.
2012/0124840 A1 5/2012 Iaccarino et al.
2012/0210586 A1 8/2012 Lelieveld et al.
2012/0297625 A1 11/2012 Madden
2013/0025578 A1 1/2013 Jones
2013/0081289 A1 4/2013 Wain et al.
2013/0174821 A1 7/2013 Jones
2014/0109735 A1 4/2014 Shepperson
2014/0165800 A1 6/2014 Griffin
2015/0158192 A1 6/2015 Tucker
2015/0174776 A1 6/2015 Hawes
2015/0190935 A1 7/2015 Griffin
2015/0190936 A1 7/2015 Griffin
2015/0290819 A1 10/2015 Giannopoulos
2015/0306777 A1 10/2015 Georgakis
2015/0314465 A1 11/2015 Giannopoulos
2015/0314466 A1 11/2015 Papadopoulos-Papageorgis
2015/0321366 A1 11/2015 Papadopoulos-Papageorgis
2017/0036360 A1 * 2/2017 Griffin ..... B26B 21/225
2017/0182672 A1 6/2017 Griffin et al.

(56) References Cited

U.S. PATENT DOCUMENTS

FOREIGN PATENT DOCUMENTS

| | | |
|---|---|---|
| EP | 2123410 | 11/2009 |
| GB | 1460732 | 1/1977 |
| GB | 2030909 | 4/1980 |
| WO | 2006127435 | 11/2006 |
| WO | 2010022192 | 2/2010 |
| WO | 2012158143 | 11/2012 |
| WO | 2014051843 | 4/2013 |
| WO | 2014094909 | 6/2014 |

OTHER PUBLICATIONS

International Search Report/Written Opinion—PCT Application No. PCT/US2015/20538, dated Jun. 24, 2015, 8 pages.
Search Report—Corresponding European Patent Application No. 13864593, dated Jul. 8, 2016, 7 pages.

* cited by examiner

SHAVING SYSTEMS

RELATED APPLICATIONS

This application is a continuation application of U.S. patent application Ser. No. 14/661,032, filed Mar. 18, 2015, now U.S. Pat. No. 9,475,202, which is a continuation application of PCT Application Serial No. PCT/US2013/052099, filed on Jul. 25, 2013 which claims priority of U.S. Provisional Application Ser. No. 61/706,533, filed on Sep. 27, 2012 and U.S. Provisional Application Ser. No. 61/706,537, filed on Sep. 27, 2012. The complete disclosure of each of these applications is hereby incorporated by reference herein.

BACKGROUND

The invention relates to shaving systems having handles and replaceable blade units. Shaving systems often consist of a handle and a replaceable blade unit in which one or more blades are mounted in a plastic housing. After the blades in a blade unit have become dull from use, the blade unit is discarded, and replaced on the handle with a new blade unit. Such systems often include a pivoting attachment between the blade unit and handle, which includes a pusher and follower configured to provide resistance during shaving and return the blade unit to a "rest" position when it is not in contact with the user's skin.

SUMMARY

In general, the present disclosure pertains to shaving systems and to replaceable shaving assemblies for use in such systems. The systems include a flexible return element, e.g., of an elastomeric material, which provides the resistance and return force that are often provided by a pusher and follower mechanism in prior art shaving systems.

In one aspect, the invention features a replaceable shaving assembly that includes a blade unit comprising a plurality of longitudinally extending blades and defining an open rinsing area surrounding the blades, a shell bearing unit, mounted on a back surface of the blade unit, the shell bearing unit defining a pair of arcuate members disposed outside of the open rinsing area, and an interface element, configured to removeably connect the blade unit to a handle, on which the shell bearing unit is pivotably mounted.

Some implementations include one or more of the following features. The shell bearing element may interact with the interface element. In some cases, arcuate members define articulating surfaces that are configured to enable pivoting of the blade unit with respect to the interface element. The shell bearing element may include a return element formed integrally with the shell bearing unit. The return element is configured to bias the blade unit towards a rest position with respect to a pivot axis that is generally parallel to a long axis of the blade unit. The return element is generally elastomeric, and may comprise a synthetic elastomer or natural rubber material. The return element may include an elongated member that extends longitudinally between the arcuate members, and in some cases may further include anchoring members that extend generally perpendicularly to the elongated member and are molded onto the arcuate members. The elongated member may include an opening configured to receive a protrusion extending from the handle interface element, e.g., a central, generally rectangular opening.

In another aspect, the invention features a shaving system that includes a handle having a distal end and a proximal end, and, mounted on the handle, a shaving assembly that includes (a) a blade unit comprising a plurality of longitudinally extending blades and defining an open rinsing area surrounding the blades; (b) a shell bearing unit, mounted on a back surface of the blade unit, the shell bearing unit defining a pair of arcuate members disposed outside of the open rinsing area; and (c) an interface element configured to removeably connect the blade unit to the handle, on which the shell bearing unit is pivotably mounted.

Some implementations of this aspect can include any one or more of the features discussed above with regard to the shaving assembly.

In a further aspect, the invention features replaceable shaving assembly that includes a blade unit, a blade unit interface element mounted on the blade unit, and a handle interface element pivotably mounted on the blade unit interface element and configured to removably receive a handle. The blade unit interface element includes a return element configured to apply a return force to the handle interface element.

Some implementations include one or more of the following features. The return force comprises a torsional force. The return element may be configured to bias the blade unit towards a rest position with respect to a pivot axis that is generally parallel to a long axis of the blade unit. The return element may be elastomeric, for example the return element may comprise a synthetic elastomer or natural rubber material. The return element may include an elongated member that extends generally parallel to the longitudinal axis of the blade unit, and in some cases may further include anchoring members that extend generally perpendicularly to the elongated member and are molded onto the arcuate members. The elongated member may include an opening configured to receive a protrusion extending from the handle interface element, e.g., a central, generally rectangular opening. In some cases, the blade unit interface element includes a pair of spaced, generally parallel arcuate members, and the elongated member extends between the arcuate members.

In yet another aspect, the invention features a shaving system that includes a handle having a distal end and a proximal end, and mounted on the handle, a shaving assembly that includes a blade unit, a blade unit interface element mounted on the blade unit, and a handle interface element pivotably mounted on the blade unit interface element and configured to removably receive the handle. The blade unit interface element includes a return element configured to apply a return force to the handle interface element.

Some implementations of this aspect can include any one or more of the features discussed above with regard to the shaving assembly.

The invention also features methods of shaving. For example, in one aspect the invention features a method of shaving comprising contacting the skin with the blade unit of a shaving system comprising a handle having a distal end and a proximal end, and a replaceable shaving assembly comprising a blade unit, a blade unit interface element mounted on the blade unit, and a handle interface element pivotably mounted on the blade unit interface element and configured to removably receive a handle, wherein the blade unit interface element includes a return element configured to apply a return force to the handle interface element. As another example, the invention features a method of shaving comprising contacting the skin with the blade unit of a shaving system comprising a handle having a distal end and a proximal end, and a replaceable shaving assembly comprising a blade unit, a plurality of longitudinally extending blades and defining an open rinsing area surrounding the blades, a shell bearing unit, mounted on a back surface of the blade unit, the shell bearing unit defining a pair of arcuate members disposed outside of the open rinsing area, and a return element disposed between the blade unit and interface element and an interface element configured to removeably connect the blade unit to a handle, on which the shell bearing unit is pivotably mounted.

DETAILED DESCRIPTION

The present disclosure relates generally to consumer products and, in particular, to shaving systems with interchangeable blade units. In one embodiment, the present disclosure features a reusable consumer product system having an interchangeable pivoting blade unit.

Figure 1:
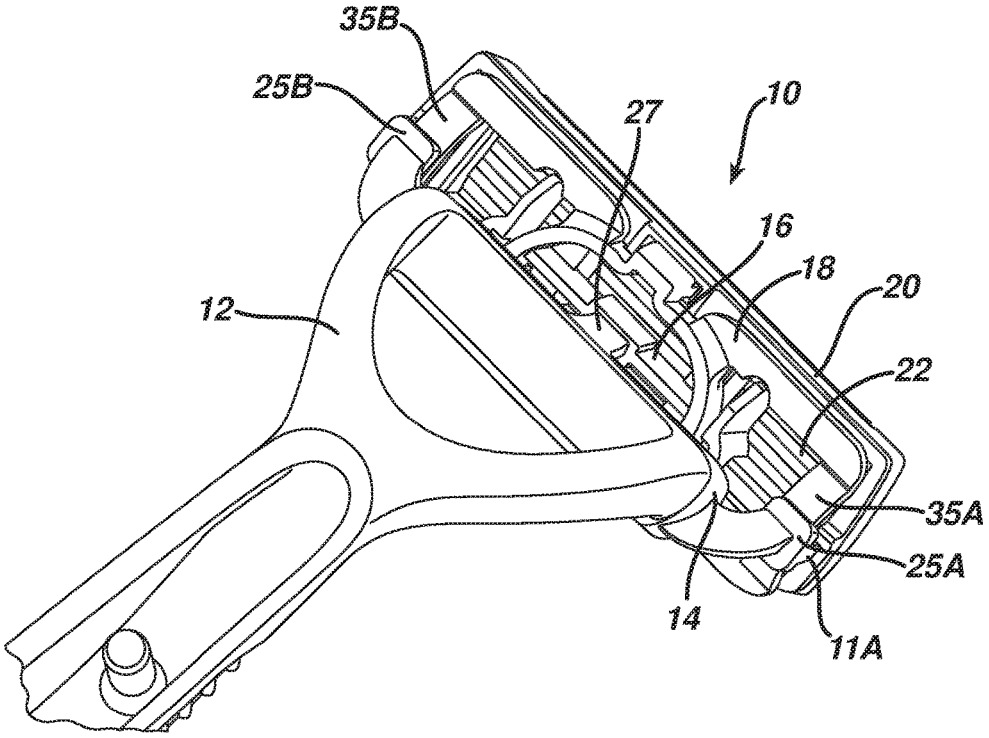
FIG. 1 is a perspective view of an assembled shaving system according to one embodiment.
Figure 8:
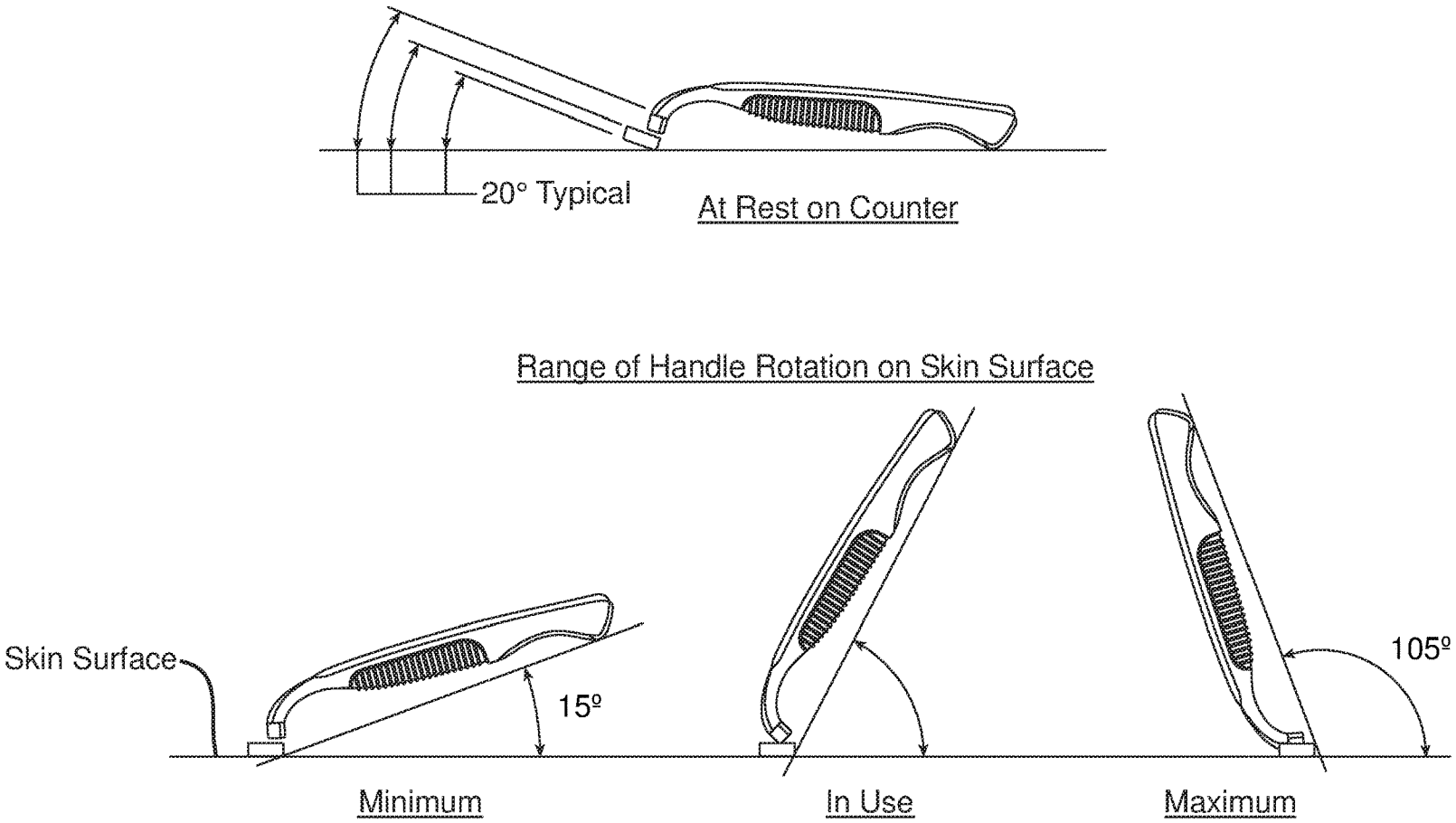
FIG. 8 is a series of diagrammatic views illustrating how the angle of the blade unit with respect to the handle is measured.

Referring to FIG. 1, a shaving system 10 includes a handle 12, an interface element 14, a return element 16, a shell bearing unit 18, and a blade unit 20, which includes a plurality of blades 22. Referring to FIG. 8, the angle of blade unit 20 with respect to handle 12 can range from approximately 15° to 105°. The handle 12 provides a manner in which the shaving system can be manipulated and leverage can be applied to achieve desired shaving results.

Figure 2:
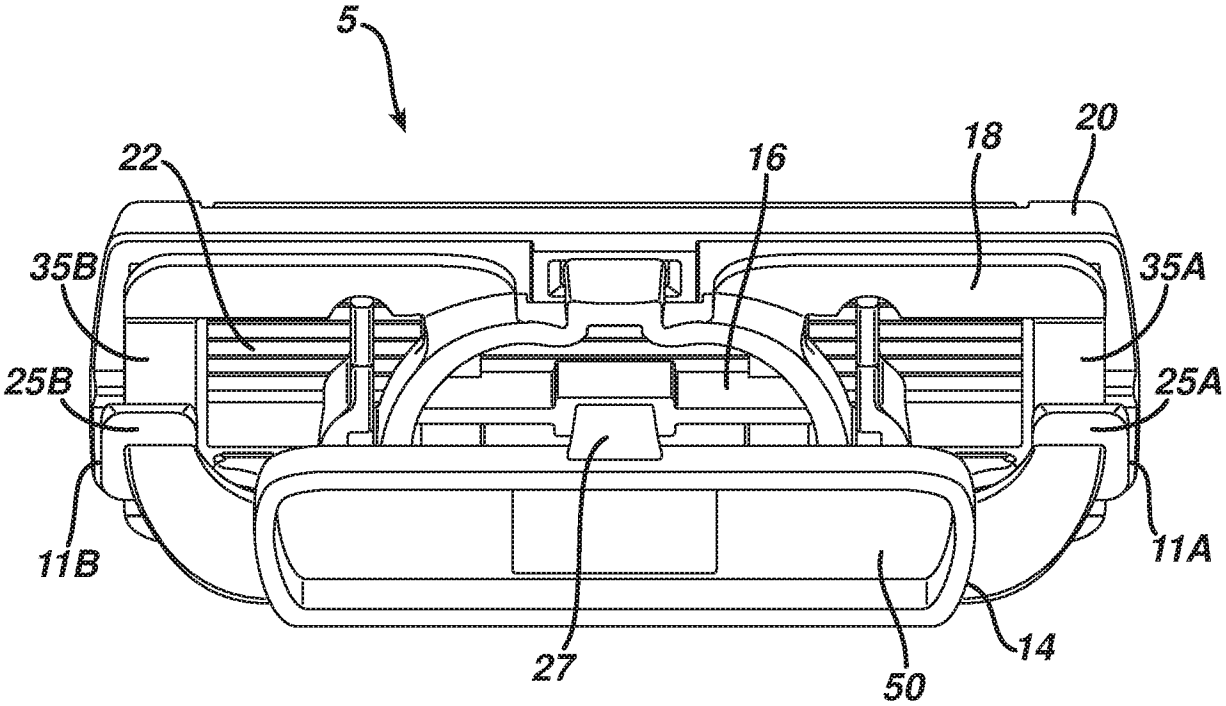
FIG. 2 is a perspective view of the shaving assembly portion of the shaving system.

Referring to FIG. 2, a shaving assembly 5 comprises the blade unit 20, shell bearing unit 18, and interface element 14. This shaving assembly would be sold to the user as a complete, replaceable unit. The interface element 14 has a handle interface portion 50 that allows the shaving assembly to be removably attached to the handle 12 (FIG. 1). This could be accomplished in a number of manners, such as a mechanical locking mechanism, magnetic interaction, etc. For example, the handle interface element 14 and handle 12 can interface in the manner discussed in U.S. Ser. No. 61/651,732, filed May 25, 2012, the full disclosure of which is incorporated herein by reference.

The shell bearing unit 18 includes arcuate members that define two articulating "shell bearing" surfaces 35A and 35B that are configured to interact with two complimentary surfaces 25A and 25B of the interface element 14. This interaction allows controlled pivoting articulation of the blade unit 20 to occur. Pivoting of the blade unit 20 is about an axis that is generally parallel to the long axis of the blade unit and is generally positioned to allow the blade unit to follow the contours of a user's skin during shaving.

Figure 4:
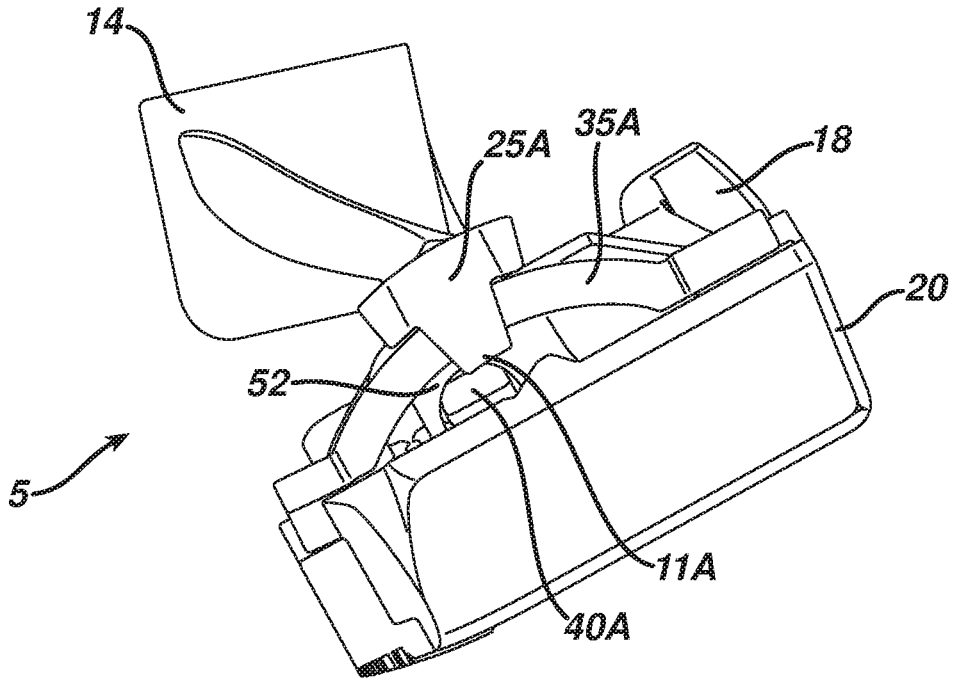
FIG. 4 is a side plan view of the shaving assembly.
Figure 5:
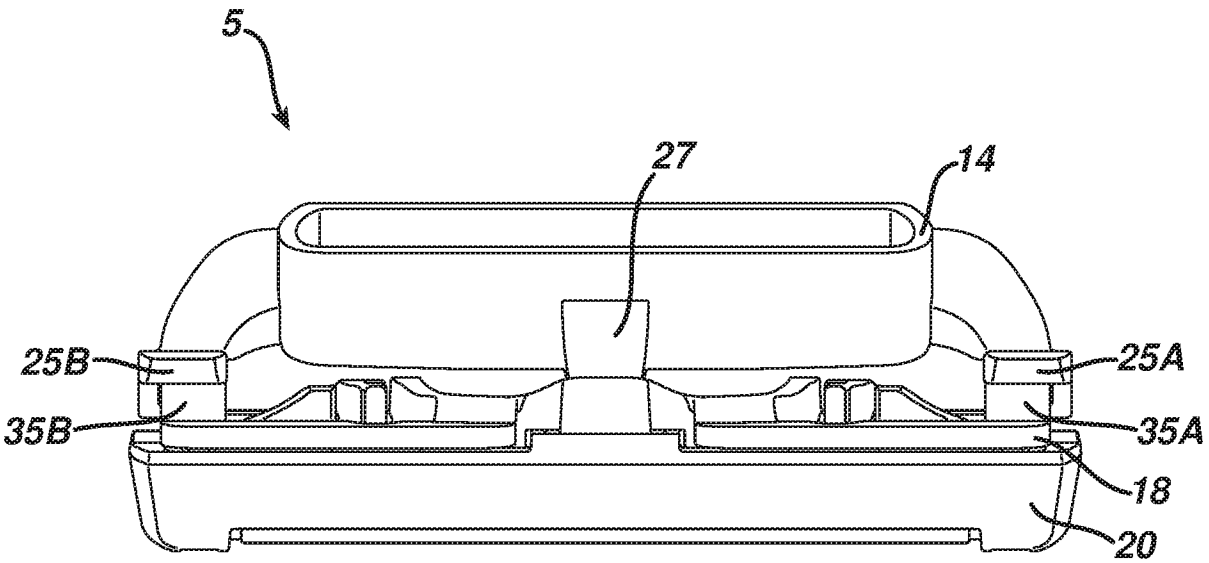
FIG. 5 is a rear plan view of the shaving system.
Figure 6:
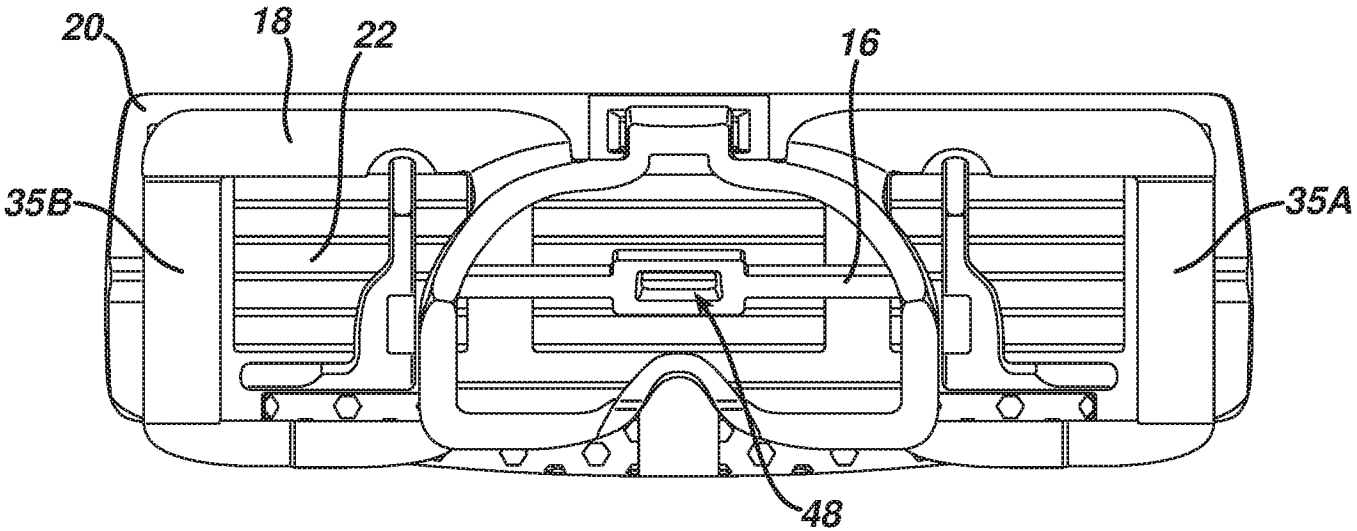
FIG. 6 is a plan view of the shell bearing unit with the return element and blade unit.

Referring to FIGS. 2 and 4, the interface element 14 includes clip members 11A, 11B that are configured to grasp the outer edges of the articulating surfaces 35A and 35B of the shell bearing unit 18 to effectively hold the shell bearing unit 18 together with the interface element 14.

Referring to FIGS. 1, 2, 3 and 5, the shell bearing articulating surfaces 35A and 35B are positioned to align with the areas 21A, 21B (FIG. 3) of the blade unit 20 that are outboard of the area of blades 22 that is exposed for rinsing. These areas 21A, 21B are generally where clips (FIG. 3) are positioned to hold the blades in place. This configuration of the articulating surfaces 35A and 35B of the shell bearing unit 18 allows debris (e.g., hair) passing between the blades 22 in the rinsing areas 23A-23C (FIG. 3) to exit the blade unit 20, resulting in less accumulation, increased rinsability and improved ease of cleaning.

Figure 3:
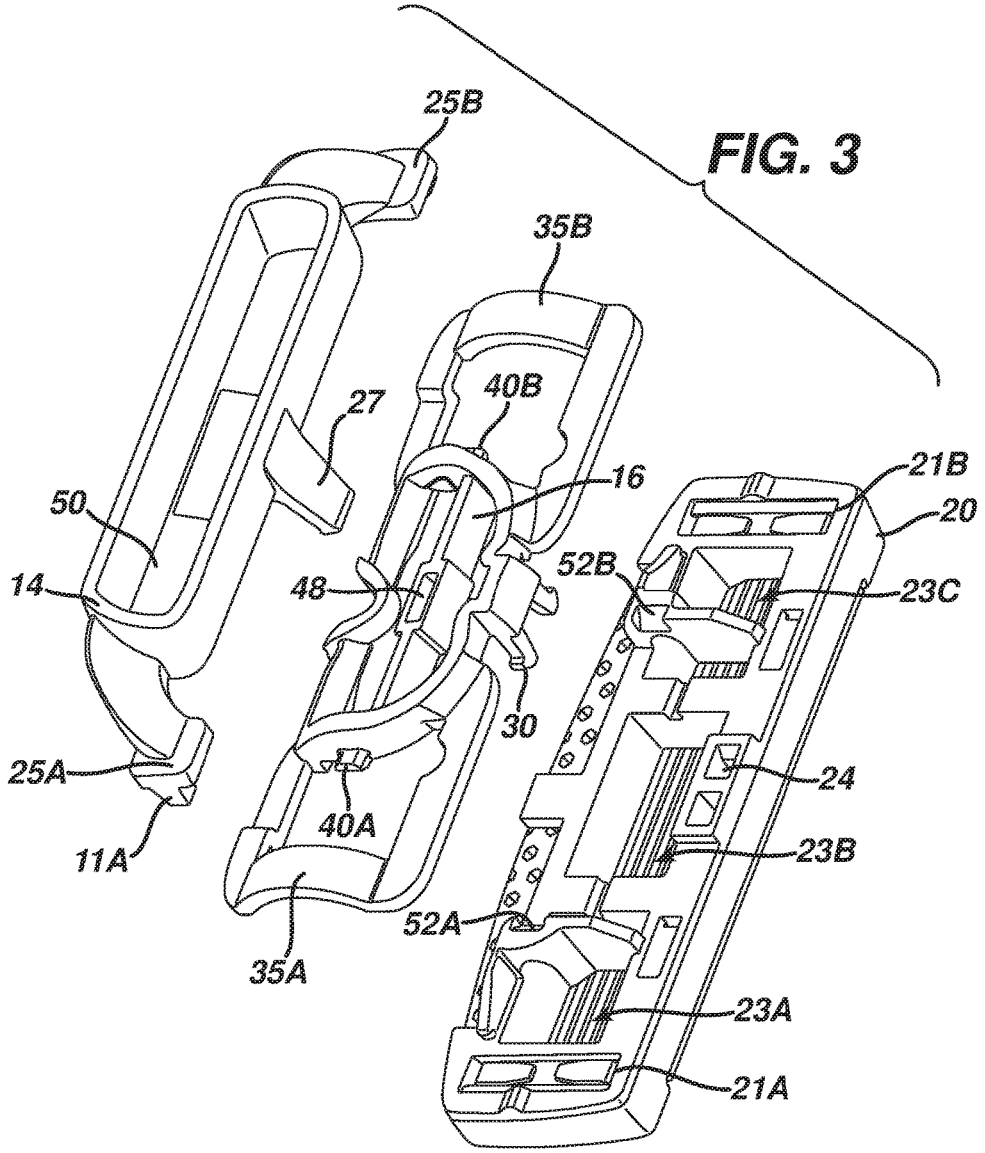
FIG. 3 is an exploded view of the shaving assembly.

Referring to FIG. 3, the blade unit 20 is mounted on shell bearing unit 18 by the positioning of a pair of fingers 30 which extend from the shell bearing unit 18 into receiving bores 24 on the blade unit 20. The receiving bores 24 may be molded integrally with the blade unit 20. In addition, the shell bearing unit 18 includes tabs 40A and 40B that are received by bores 52A and 52B (FIG. 3) on the blade unit 20 and serve as lateral attachment points for the blade unit 20.

Referring to FIGS. 1-3 and 6, a return element 16 extends longitudinally between the two arcuate members of the shell bearing unit 18. The return element 16 may be integrally molded with the shell bearing unit 18, e.g., by co-molding. It is noted that the term "co-molding," as used herein, includes transfer molding and other techniques suitable for molding two or more different materials into a single part.

The return element 16 includes an opening 48 that is configured to receive a protrusion 27 that extends from the interface element 14 as shown, e.g., in FIG. 2. Preferably, opening 48 is in the center of the return element as shown. The interaction of the protrusion 27 and return element 16 provides resistance during shaving, limiting the free pivoting of the blade unit about the pivot axis described above, and provides a torsional return force that biases the blade unit towards its rest position, in the same manner that resistance and return are typically provided by a pusher/follower assembly. No torque is applied at rest, but as soon as a force is applied to the blade unit a torsional load is generated on the return element. In some implementations, the return element is designed so that its geometry provides a force of up to 50 grams, e.g., from about 5 to 50 grams or about 10 to 40 grams.

Figure 7:
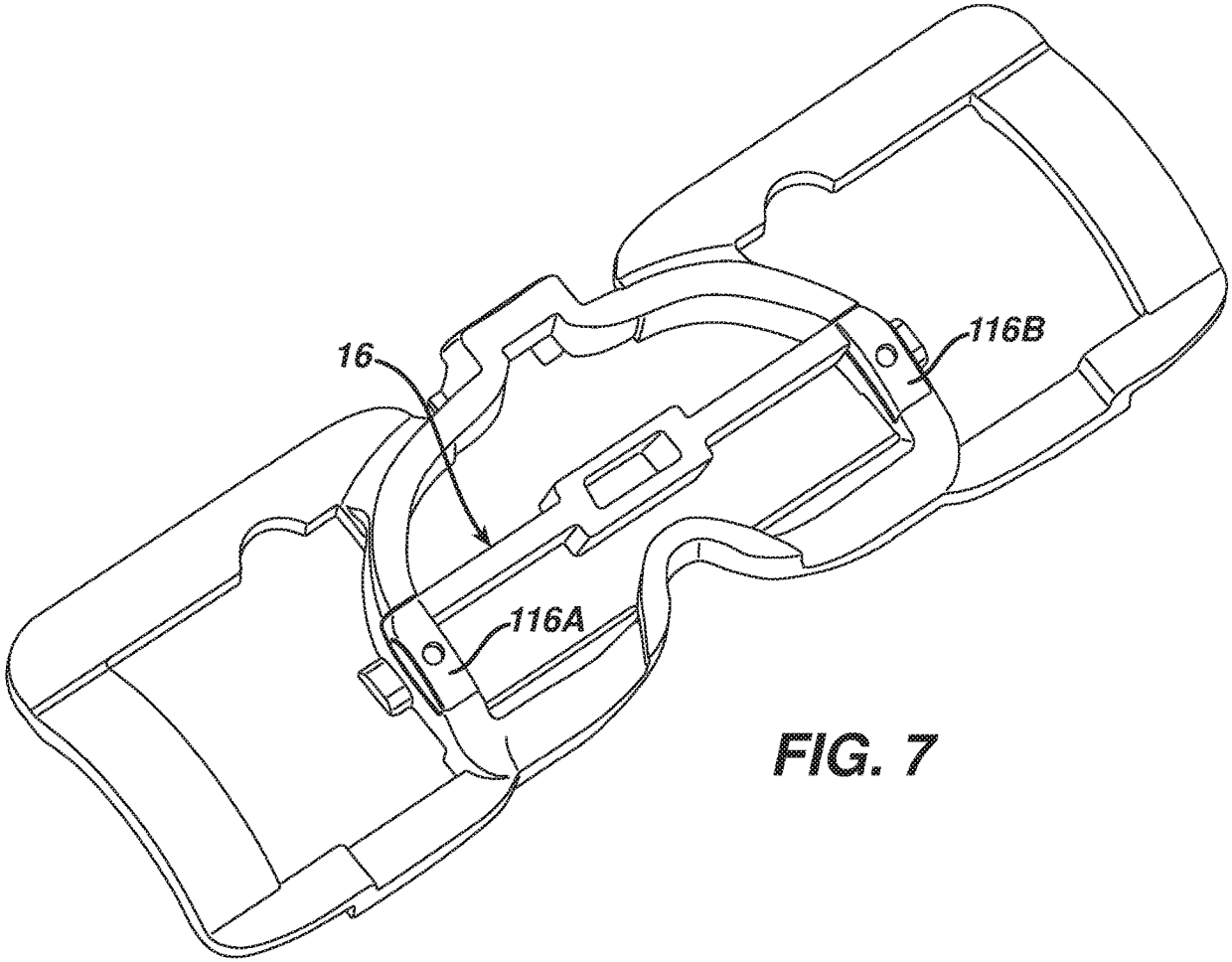
FIGS. 7-7B are perspective views showing a shell bearing assembly and return element according to an alternate embodiment.
Figure 7A:
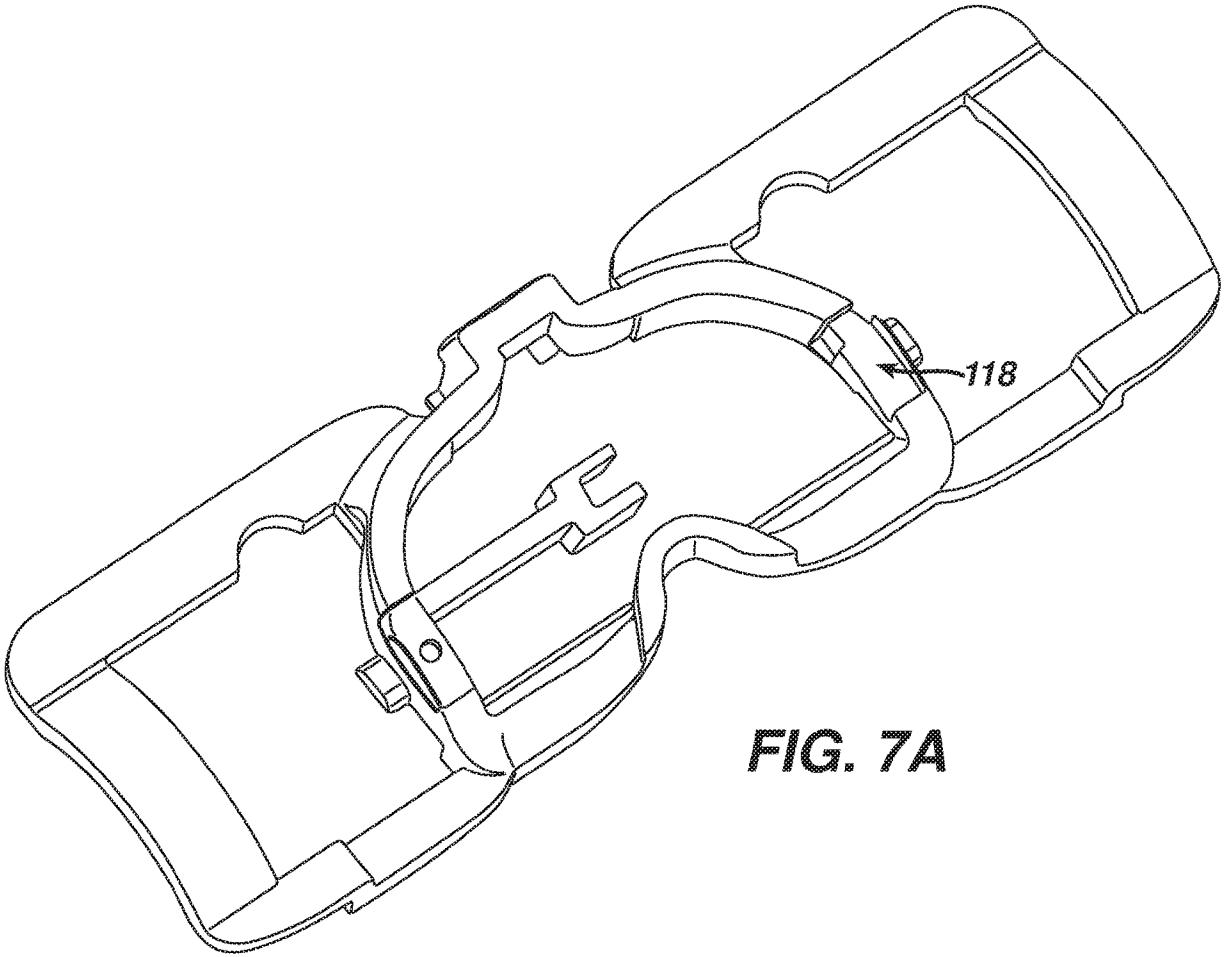
In FIG. 7A part of the return element is cut away to show the underlying area of the shell bearing assembly, and in FIG. 7 the guard is omitted whereas in FIG. 7B it is included.
Figure 7B:
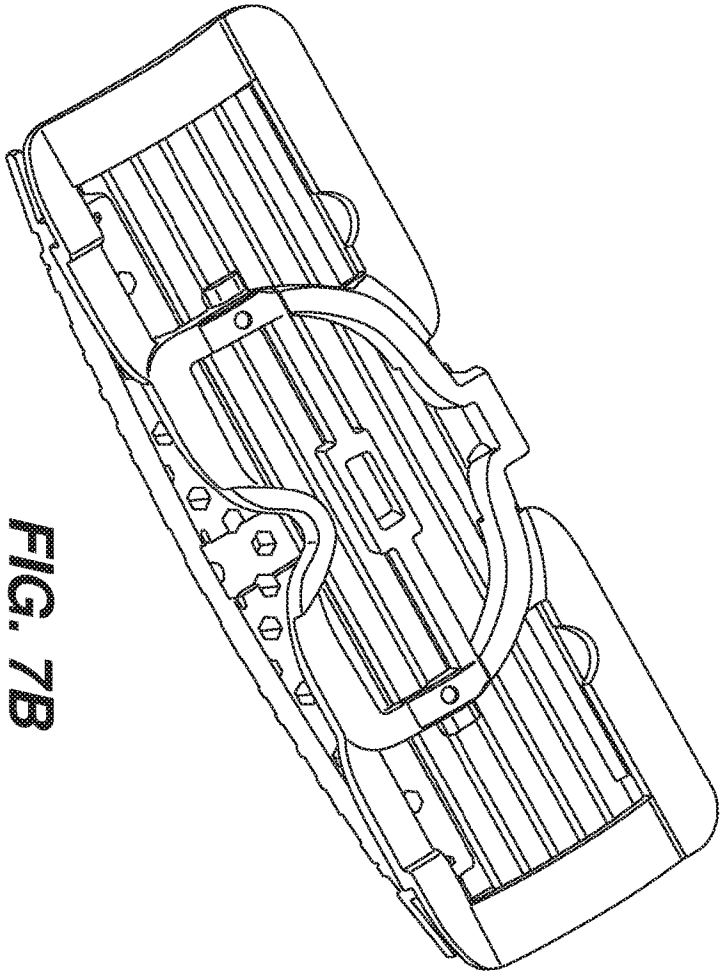

As shown in FIGS. 7-7B, in some implementations the return element 16 includes a pair of anchoring portions 116A, 116B, that extend generally perpendicularly to the longitudinally extending portion of the return element 16 and are molded onto recessed areas 118 (FIG. 7A) of the shell bearing member.

In an alternate embodiment (not shown), a portion of the return element 16 is reinforced with a hard plastic or another stiffening element, so that the movement of the return element 16 is primarily rotational and lateral deflection is minimized.

The return element 16 can be formed, for example, from synthetic or natural rubber materials. Preferably, the return element is formed from the same material as the guard. Suitable materials are well known in the shaving system art, and include, for example, polyether-based thermoplastic elastomers (TPEs) available from Kraiburg HTP, thermoplastic urethanes (TPUs), silicones, and polyether-based thermoplastic vulcanizate elastomer (TPVs) available from GLS PolyOne Corporation under the tradename Santoprene™. The elastomeric material is selected to provide a desired degree of restoring force and durability. In some implementations, the elastomer has a Durometer of less than about 45 Shore A, e.g., from about 20 to 90 Shore A.

A number of embodiments have been described. Nevertheless, it will be understood that various modifications may be made without departing from the spirit and scope of the disclosure.

For example, while the shell bearings have been shown as positioned entirely outboard of the rinsing areas, a small amount of the rinsing areas can be obstructed if necessary, e.g. less than 10%, preferably less than 5%, and more preferably less than 1% of the total rinsing area.

Accordingly, other embodiments are within the scope of the following claims.

What is claimed is:

1. A replaceable shaving assembly comprising:

a blade unit comprising a housing and a plurality of longitudinally extending blades disposed within the housing, the blade unit defining an open rinsing area surrounding the blades;

a shell bearing unit disposed on a back surface of the blade unit, the shell bearing unit including a pair of shell bearing surfaces disposed outside of the open rinsing area;

an elastomeric return element configured to bias the blade unit towards a rest position with respect to a pivot axis that is generally parallel to a long axis of the blade unit; and wherein the shell bearing unit further comprises a central closed-loop member, positioned between the shell bearing surfaces, and the return element comprises an elongated member that extends longitudinally across the closed-loop member.

2. The shaving assembly of claim 1, wherein the pair of shell bearing surfaces are articulating surfaces that are configured to enable pivoting of the blade unit with respect to a handle on which the shaving assembly is mounted.

3. The shaving assembly of claim 1, wherein the return element is formed integrally with the shell bearing unit.

4. The shaving assembly of claim 1, wherein the elastomeric return element has a durometer of from about 20 to 90 Shore A.

5. The shaving assembly of claim 1, wherein the elongated member that extends generally parallel to the long axis of the blade unit.

6. A shaving system comprising:

a handle having a distal end and a proximal end; and pivotably mounted on the handle, a shaving assembly comprising:

a blade unit comprising a housing and a plurality of longitudinally extending blades disposed within the housing, the blade unit defining an open rinsing area surrounding the blades;

a shell bearing unit disposed on a back surface of the blade unit, the shell bearing unit including a pair of shell bearing surfaces disposed outside of the open rinsing area;

an elastomeric return element configured to bias the blade unit towards a rest position with respect to a pivot axis that is generally parallel to a long axis of the blade unit; and wherein the shell bearing unit further comprises a central closed-loop member, positioned between the shell bearing surfaces, and the return element comprises an elongated member that extends longitudinally across the closed-loop member.

7. The shaving system of claim 6, wherein the return element is formed integrally with the shell bearing unit.

8. The shaving system of claim 6, wherein the elastomeric return element has a durometer of from about 20 to 90 Shore A.

9. The shaving system of claim 6, wherein the elongated member that extends generally parallel to the long axis of the blade unit.

10. The shaving system of claim 6, wherein the elongated member includes a central opening.

11. The shaving system of claim 6, wherein the blade unit is removable from the handle by a user.

12. A method of shaving comprising:

providing a shaving system comprising a handle having a distal end and a proximal end, and, pivotably mounted on the handle, a replaceable shaving assembly comprising:

a blade unit comprising a housing and a plurality of longitudinally extending blades disposed within the housing, the blade unit defining an open rinsing area surrounding the blades;

an elastomeric return element configured to bias the blade unit towards a rest position with respect to a pivot axis that is generally parallel to a long axis of the blade unit; and a shell bearing unit disposed on a back surface of the blade unit, the shell bearing unit including a pair of shell bearing surfaces disposed outside of the open rinsing area;

wherein the shell bearing unit further comprises a central closed-loop member, positioned between the shell bearing surfaces, and the return element comprises an elongated member that extends longitudinally across the closed-loop member; and contacting a user's skin with the blade unit.

* * * * *